US007902737B2

(12) United States Patent
Lee

(10) Patent No.: US 7,902,737 B2
(45) Date of Patent: Mar. 8, 2011

(54) LIGHT EMISSION DEVICE WITH ENHANCED IMAGE LUMINANCE AND DISPLAY HAVING THE SAME

(75) Inventor: Byong-Gon Lee, Yongin-si (KR)

(73) Assignee: Samsung SDI Co., Ltd. (KR)

( * ) Notice: Subject to any disclaimer, the term of this patent is extended or adjusted under 35 U.S.C. 154(b) by 273 days.

(21) Appl. No.: 12/151,019

(22) Filed: May 2, 2008

(65) Prior Publication Data

US 2009/0033205 A1 Feb. 5, 2009

(30) Foreign Application Priority Data

Aug. 3, 2007 (KR) ..... 10-2007-0078067

(51) Int. Cl.
*H01J 1/62* (2006.01)
*H01J 63/04* (2006.01)

(52) U.S. Cl. ..... 313/495; 313/496; 313/497; 313/310; 257/10; 257/11

(58) Field of Classification Search ..... None
See application file for complete search history.

(56) References Cited

U.S. PATENT DOCUMENTS

2005/0280350 A1* 12/2005 Seon ..... 313/496
2007/0019130 A1* 1/2007 Kuo ..... 349/65

* cited by examiner

*Primary Examiner* — Peter J Macchiarolo
*Assistant Examiner* — Tracie Green
(74) *Attorney, Agent, or Firm* — Knobbe Martens Olson & Bear LLP

(57) ABSTRACT

A light emission device and a display having the light emission device are provided. The light emission device includes first and second substrates arranged opposite to each other, an electron emission unit provided on the first substrate, a light emission unit provided on the second substrate, and spacers that are supportably disposed between the first and second substrates. The spacers are formed in a pillar configuration and each side of the spacers is arranged at an acute angle with respect to an edge of driving electrodes of the electron emission unit.

12 Claims, 8 Drawing Sheets

LIGHT EMISSION DEVICE WITH ENHANCED IMAGE LUMINANCE AND DISPLAY HAVING THE SAME

CROSS-REFERENCE TO RELATED APPLICATION

This application claims priority to and the benefit of Korean Patent Application No. 10-2007-0078067 filed in the Korean Intellectual Property Office on Aug. 3, 2007, the entire content of which is incorporated herein by reference.

BACKGROUND OF THE INVENTION

1. Field of the Invention

The present embodiments relate to a light emission device and a display having the same. More particularly, the present embodiments relate to a light emission device that can improve luminance by improving disposition of spacers, and a display having the same.

2. Description of the Related Art

In the present context, all devices that can emit light to an external side are called light emission devices. A light emission device having a front substrate on which a phosphor layer and an anode electrode are formed and a rear substrate on which electron emission regions and driving electrodes are formed is well known. In such a light emission device, a vacuum is formed in a space defined between the front and rear substrates and the phosphor layer is excited by electrons emitted from the electron emission regions, thereby emitting visible light.

Describing the operation of a light emission device, driving voltages (a scan driving voltage and a data driving voltage) are applied to the driving electrodes to control an amount of electrons emitted from the electron emission regions and a direct current voltage of hundreds to thousands of volts is applied to the anode electrode to accelerate the electrons emitted from the electron emission regions toward the phosphor layer.

The light emission device may be used as a light source of a liquid crystal display having a passive type display panel. That is, the light emission device may be used to emit light toward the passive type display panel of the liquid crystal display.

Such a light emission device can be driven using less power than a cold cathode fluorescent lamp (CCFL) device or a light emission diode (LED) device. Further, the light emission device can easily be large-sized and have a simple optical structure.

The above information disclosed in this Background section is only for enhancement of understanding of the background of the present embodiments and therefore it may contain information that does not form the prior art that is already known in this country to a person of ordinary skill in the art. The present embodiments provide numerous advantages over the problems with the prior art.

SUMMARY OF THE INVENTION

In a light emission device, the front and rear substrates are sealed together by a sealing member and a vacuum is formed in an internal space defined between the front and rear substrates to form a vacuum vessel. Disposed between the front and rear substrates are spacers for uniformly maintaining a gap between the front and rear substrates against an atmospheric pressure applied to the vacuum vessel.

The spacers are disposed on a non-emission region of the light emission device. In a process for installing the spacers, an imaginary site (hereinafter, referred to as "an imaginary spacer site") is preset to obtain a disposing tolerance of the spacers and to prevent problems caused by charges charged on the spacers during operation of the light emission device. The imaginary spacer site is included in the non-emission region of the light emission device.

However, since the imaginary spacer site is formed in a light emission region of the light emission device, a luminance difference occurs in each unit pixel between a portion corresponding to the imaginary spacer site and a portion except for the imaginary spacer site when the light emission device emits light. This causes a luminance non-uniformity problem of the light emission device.

Therefore, exemplary embodiments provide a light emission device that can enhance a luminance property by making the luminance of each unit pixel uniform, and a display having the light emission device.

In an exemplary embodiment, a light emission device includes first and second substrates arranged opposite to each other, an electron emission unit provided on the first substrate, a light emission unit provided on the second substrate, and spacers that are supportably disposed between the first and second substrates. The spacers are formed in a pillar configuration and each side of the spacers is arranged at an acute angle with respect to an edge of driving electrodes of the electron emission unit.

The spacers may be formed in a square pillar configuration.

The driving electrodes may include cathode electrodes and gate electrodes disposed perpendicular to the cathode electrodes. At this point, the spacers may be located at regions where the cathode electrodes do not intersect the gate electrodes.

The light emission device may further include a plurality of pixel areas spaced apart from each other by a predetermined gap. At this point, the spacers may be disposed in the gap. The spacers may be formed in an exact square pillar configuration.

In another exemplary embodiment, a display includes a display panel displaying an image and a display device having the above-described structure and supplying light to the display panel.

DETAILED DESCRIPTION OF THE EMBODIMENTS

Figure 1:
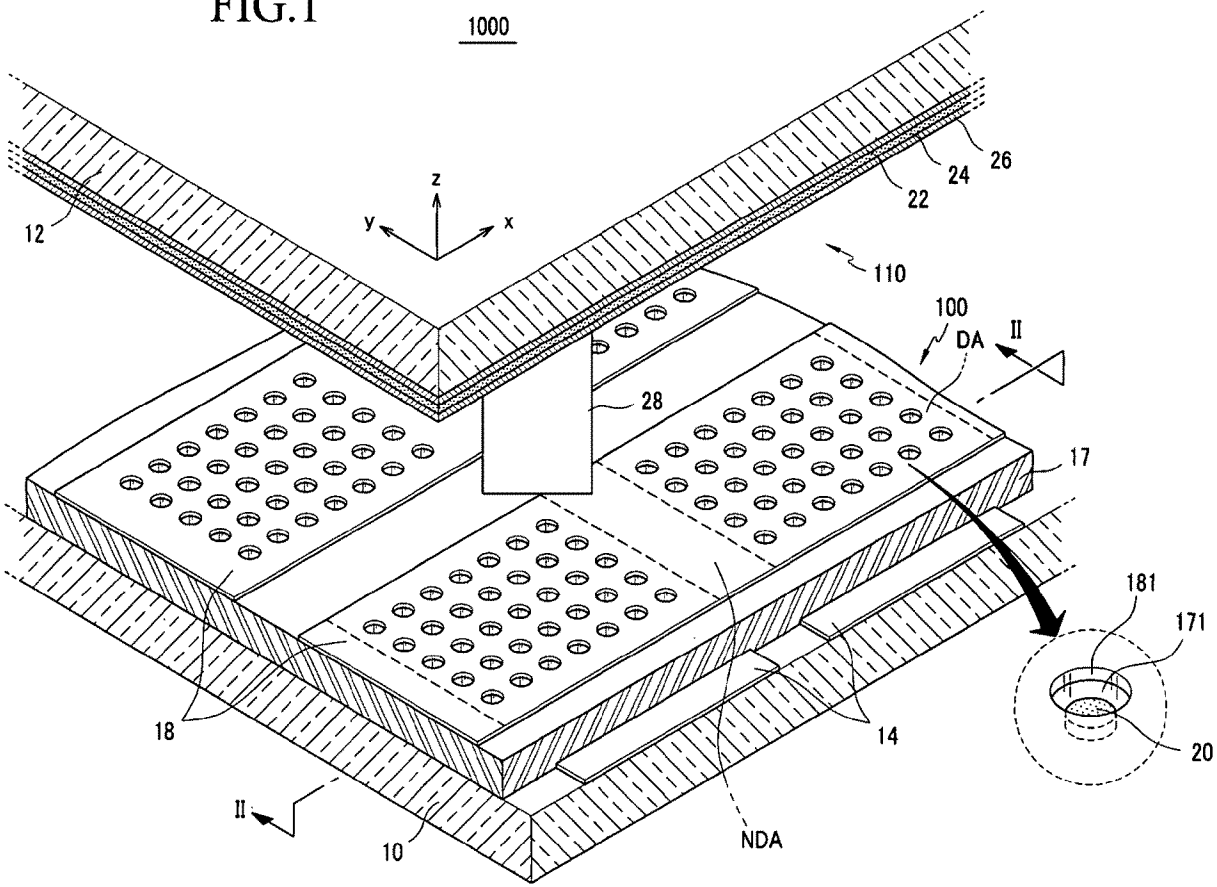
FIG. 1 is a partial exploded perspective view of a light emission device according to an exemplary embodiment.

The present embodiments will be described more fully hereinafter with reference to the accompanying drawings, in which exemplary embodiments are shown. As those skilled in the art would realize, the described embodiments may be modified in various different ways, all without departing from the spirit and scope of the present embodiments. Like reference numerals designate like elements throughout the specification.

It will be understood that when an element such as a layer, film, region, or substrate is referred to as being "on" another element, it can be directly on the other element or intervening elements may also be present. In contrast, when an element is referred to as being "directly on" another element, there are no intervening elements present.

Terms such as "first", "second", "third", and the like are used to explain a variety of different portions, different components, different regions, different layers, and/or different sections. However, it will be understood that the present embodiments are not limited to this. That is, the terms are used only to discriminate different portions, different components, different sections, different layers, or different sections. Therefore, in the following description, a first portion, a first region, a first layer, or a first section may be referred to as a second portion, a second region, a second layer, or a second section, respectively.

In the following description, the technical terms are used only to explain a specific exemplary embodiment while not limiting the present embodiments. The terms of a singular form may include plural forms unless referred to the contrary. The meaning of "include" specifies a property, a region, a fixed number, a step, a process, an element, and/or a component but does not exclude other properties, regions, fixed numbers, steps, processes, elements, and/or components.

Terms such as "under", "above", and the like that represent a relative space may be used to more easily describe a specific portion of a member illustrated in the drawings. It is intended that the terms include other meanings or operations as well as a specific meaning or operation illustrated in the drawings. For example, when a device illustrated in the drawings is turned over, a first portion that was described as being located under a second portion may be located above the second portion. Therefore, the meaning "under" includes both of upper and lower directions. The device may rotate by 90° or other angles and thus the terms representing the relative space may be construed in accordance with the rotation of the device.

Although not specifically defined, all of the terms including the technical and scientific terms used herein have meanings understood by ordinary persons skilled in the art. The terms have specific meanings coinciding with related technical references and the present specification as well as lexical meanings. That is, the terms are not construed as ideal or formal meanings.

In an exemplary embodiment, all devices that emit light to an external side can be regarded as a light emission device. Therefore, it can be understood that all displays that transfer information by displaying symbols, letters, numerals, and images are light emission devices. Further, the light emission device may be used as a light emission panel emitting light toward a passive type display panel.

Figure 2:
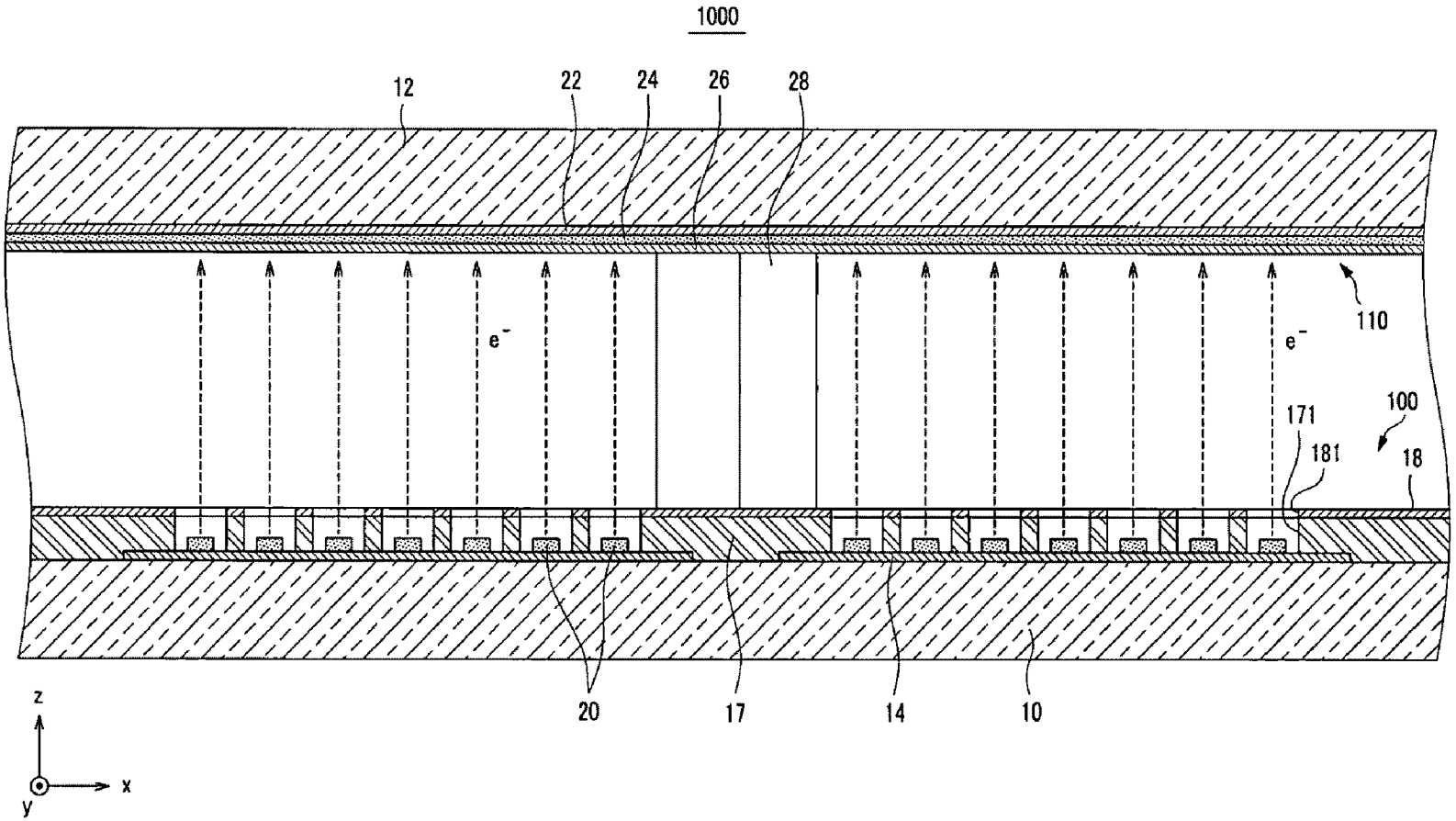
FIG. 2 is a sectional view taken along line II-II of FIG. 1.

FIG. 1 is a schematic exploded perspective view of a light emission device according to a first exemplary embodiment. FIG. 2 is a sectional view taken along line II-II of FIG. 1.

Referring to FIG. 1, a light emission device 1000 includes first and second substrates 10 and 12 arranged opposite to each other at a predetermined distance in a parallel manner. A sealing member (not shown) is provided between the first and second substrates 10 and 12 along edge portions thereof to seal together the first and second substrates 10 and 12 and thus form a vacuum vessel. The interior of the vacuum vessel is vacuumed to a degree of vacuum of about $10^{-6}$ Torr.

An electron emission unit 100 formed of an array of electron emission elements is provided on an inner surface of the first substrate 10 facing the second substrate 12. A light emission unit 110 including a phosphor layer 24 and an anode electrode 22 is provided on an inner surface of the second substrate 12 facing the first substrate 10.

The light emission device may be, for example, a field emitter array (FEA) device, a surface-conduction-emission (SCE) device, a metal-insulation layer-metal (MIM) device, or a metal-insulation layer-semiconductor (MIS) device, or other types of device in accordance with a structure of the electron emission unit. In the following description, the FEA device will be explained by way of example.

First, cathode electrodes 14 are formed on the first substrate 10. The cathode electrodes 14 are arranged in a stripe pattern extending in a y-axis direction of the first substrate 10. A first insulation layer 17 is formed on the first substrate 10 while covering the cathode electrodes 14, and gate electrodes 18 are formed on the first insulation layer 17. The gate electrodes 18 are formed in a stripe pattern extending in an x-axis direction intersecting the cathode electrodes 14.

Therefore, intersecting regions of the cathode and gate electrodes 14 and 18 may be pixel areas DA corresponding to unit pixels of the light emission device. The pixel areas DA are formed in a predetermined pattern on the first substrate 10. In this exemplary embodiment, the pixel areas DA are formed in a square shape but may be in any shape such as circular, rectangular, triangular, oval, elliptical or other shape.

Further, the pixel areas DA are spaced apart from each other by a predetermined gap. A non-pixel area NDA is formed in a lattice configuration between the pixel areas DA. The non-pixel area NDA is formed on a region where the cathode electrodes 14 and the gate electrodes 18 do not intersect.

Electron emission regions 20 are formed on the cathode electrodes 14 at each of the pixel areas DA.

The electron emission regions 20 are formed of a material that emits electrons when an electric filed is applied thereto under a vacuum atmosphere, such as, for example, a carbon-based material or a nanometer-sized material. The electron emission regions 20 may be formed of, for example, carbon nanotubes, graphite, graphite nanofibers, diamond, diamond-like carbon, fullerene ($C_{60}$), silicon nanowires, or a combination thereof.

Alternatively, the electron emission regions 20 may be formed of a molybdenum-based (Mo-based) material or a silicon-based (Si-based) material. The electron emission regions are preferably formed into a structure having a sharp tip.

As shown in FIG. 1, first openings 171 and second openings 181 are respectively formed in the first insulation layer 17 and the gate electrodes 18 to expose the electron emission regions 20 on the first substrate 10. That is, the electron emission regions 20 are formed on the cathode electrodes 14 and exposed through the first and second openings 171 and 181 to an external side. In the present exemplary embodiment, although each of the electron emission regions 20 is formed in a single layer and a circular pillar shape, the present embodiments are not limited to this configuration.

Next, an anode electrode 22, a phosphor layer 24, and a reflective layer 26 are formed on the inner surface of the second substrate 12.

The anode electrode 22 receives an external high voltage (e.g., from about 10 kV to about 20 KV) required for accelerating electron beams and thus maintains the phosphor layer 24 at a high electric potential state. The anode electrode 22 may be a transparent conductive layer formed of indium thin oxide (ITO). In this exemplary embodiment, the phosphor layer 24 is formed on the anode electrode 22. However, the anode electrode 22 may be formed on the phosphor layer 24. When the phosphor layer 24 and the anode electrode 22 are layered in this order on the second substrate 12, the phosphor layer 24 is adjacent to the second substrate 12. Accordingly, since the anode electrode 22 does not interfere with the light emitted from the phosphor layer 24, the anode electrode 22 may be formed of an opaque metal having a high degree of electric conductivity.

The phosphor layer 24 may be a white phosphor layer. The phosphor layer 24 may be formed on an entire active area of the second substrate 12 or may be formed in a predetermined pattern in which one white phosphor layer is located corresponding to each of the pixel regions.

Alternatively, the phosphor layer 24 may be realized through a combination of red, green, and blue phosphor layers, in which case the phosphor layers are provided in a predetermined pattern for each of the pixel areas. In FIG. 1, the phosphor layer 24 is shown formed on the entire active area of the second substrate 12, and is a white phosphor layer, however, the present embodiments are not limited to this configuration.

The reflective layer 26 is formed of a metal such as, for example, aluminum (Al). The reflective layer 26 is formed on the phosphor layer 24. The reflective layer 26 is thinly formed to have a thickness of thousands of A and may be provided with small holes through which the electron beams pass. Among the visible light emitted from the phosphor layer 24, the visible light that is emitted from the phosphor layer 24 toward the first substrate 10 is reflected by the reflective layer 26 toward the second substrate 12, thereby improving the luminance of the light emission surface.

A plurality of spacers 28 are disposed between the first and second substrates 10 and 12 to resist atmospheric pressure applied to the vacuum vessel to thereby ensure that the gap between the first and second substrates 10 and 12 is uniformly maintained.

The above-described light emission device 100 includes the plurality of pixel areas DA, and the non-pixel area NDA formed between the pixel areas DA.

The spacers 28 are formed in a pillar shape and disposed between the pixel areas DA along the x-axis or y-axis. The spacers 28 may be formed in a square pillar configuration or an angular pillar configuration. In FIG. 1, a spacer 28 is shown formed in the square pillar configuration and disposed between four pixel areas DA.

In the light emission device 1000, the first and second substrates 10 and 12 may be spaced apart from each other by from about 5 to about 20 mm and the height of the spacers 28 may correspond to the gap between the first and second substrates 10 and 12. A diagonal width of each of the spacers 28 is greater than a distance between two adjacent gate electrodes 18 so that the spacer 28 can partly overlap the two adjacent gate electrodes 18.

The above-described light emission device 1000 is driven as predetermined external voltages are applied to the cathode electrodes 14, the gate electrodes 18, and the anode electrode 22. For example, either the cathode electrodes 14 or the gate electrodes 18 receive a scan driving voltage, and the other one of the cathode electrodes 14 and the gate electrodes 18 receive a data driving voltage.

The anode electrode 22 receives a positive direct current voltage of, for example, from about 10 kV to about 20 kV required for accelerating electron beams.

As a result, electric fields are formed around the electron emission regions 20 at pixel areas where a voltage difference between the cathode and gate electrodes 14 and 18 is equal to or greater than a threshold value, and thus electrons e− are emitted from the electron emission regions 20, as represented by the dotted lines in FIG. 2. The emitted electrons e− are attracted by the high voltage applied to the anode electrode 22 to thereby collide with corresponding areas of the phosphor layer 24 and excite the corresponding areas of the phosphor layer 24.

In order to minimize the number of the electron emission regions 20 included in imaginary spacer regions 40, an arrangement configuration of the spacers 28 is improved in this exemplary embodiment.

Figure 4:
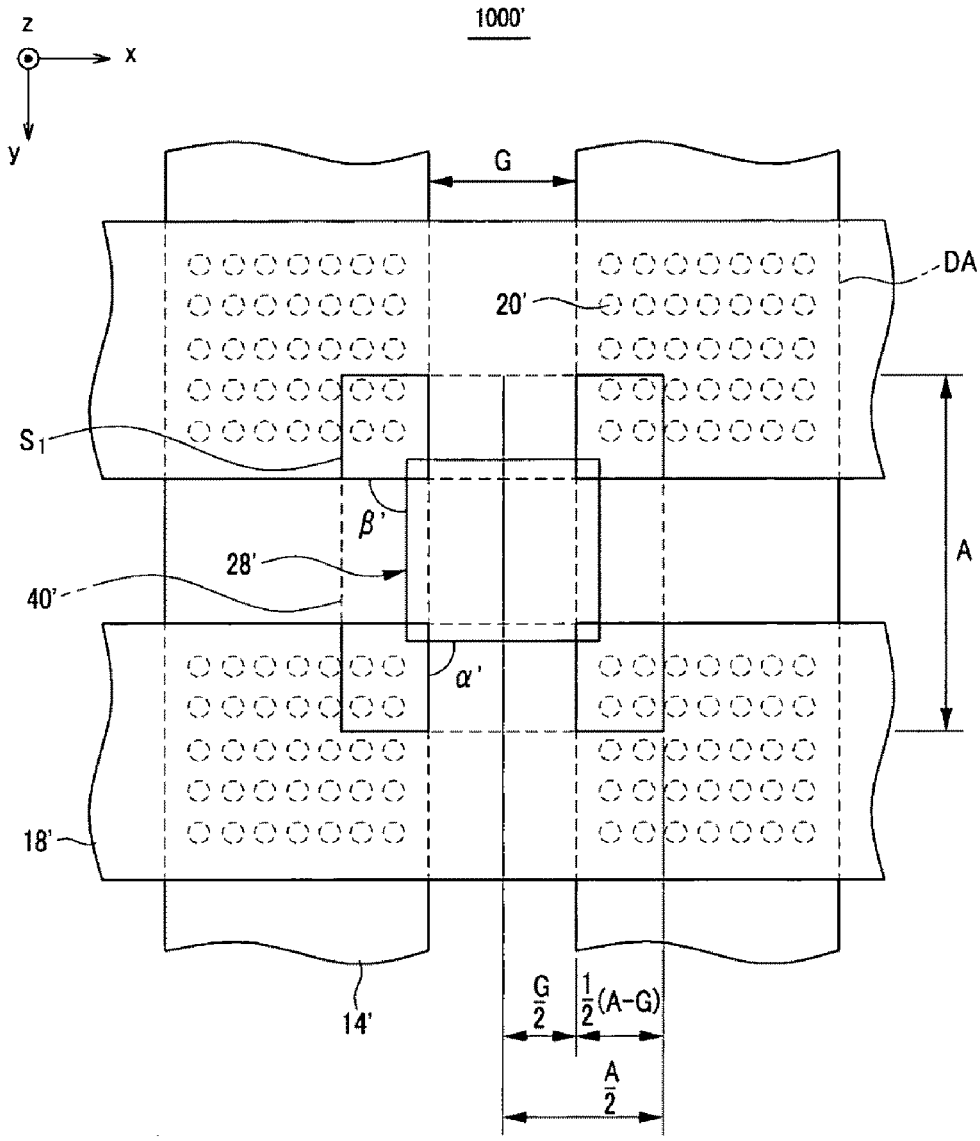
FIG. 4 is a top plan view of a major portion of a light emission device according to a comparative example.

As shown in FIG. 4, sides of a spacer 28' are parallel or perpendicular to an extending direction of driving electrodes 14' and 18' (e.g., gate electrodes 18') of a light emission device 1000'. When the spacers 28' are formed in a square pillar configuration, the gate electrodes 18' and x-axis sides (hereinafter, referred to lateral sides) of the spacers 28' are parallel with each other.

Figure 3:
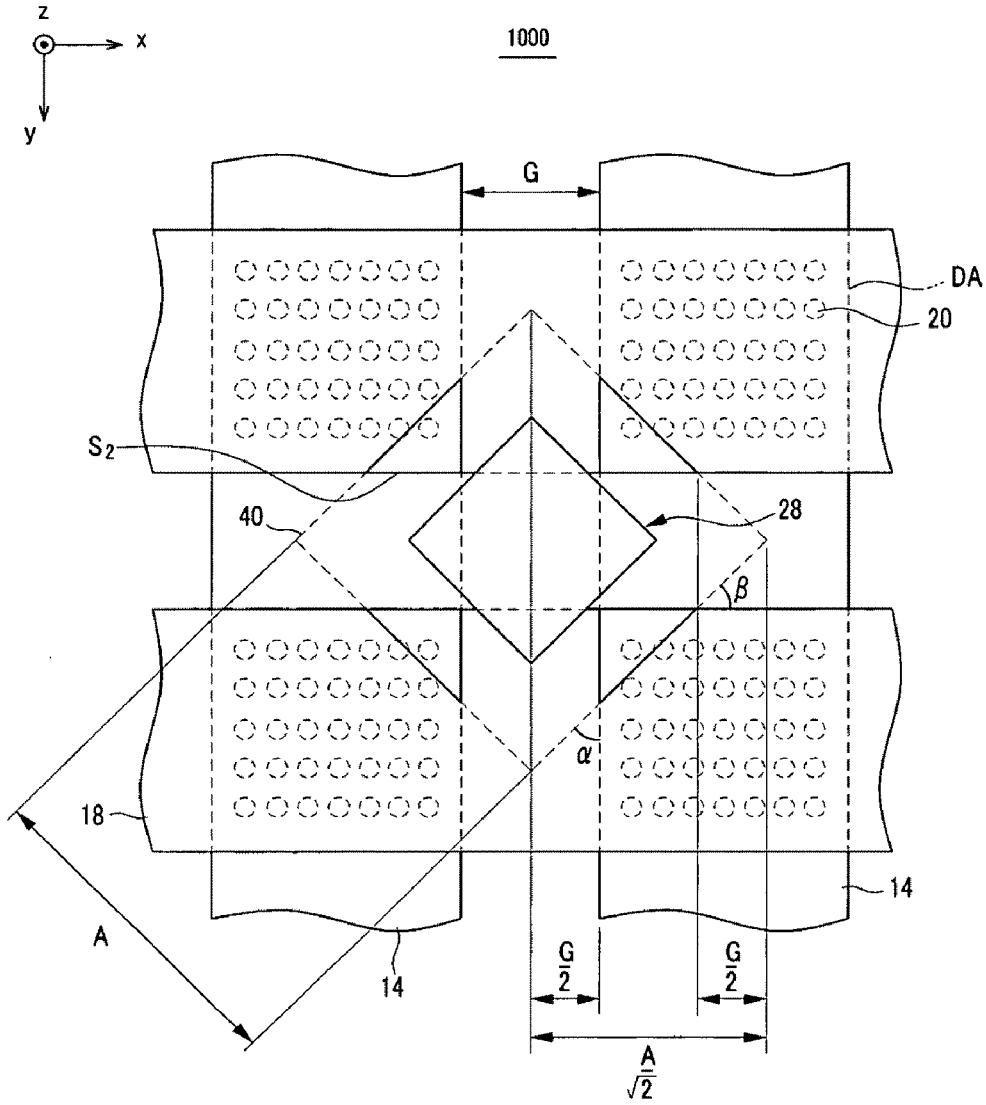
FIG. 3 is a top plan view of a major portion of the light emission device of FIG. 1.

FIG. 3 shows the electron emission unit 100 of the light emission device 1000 of FIG. 1.

Referring to FIG. 3, a spacer 28 is disposed on the insulation layer such that each side thereof is at an acute angle $\alpha$ and $\beta$ with respect to an edge of the corresponding cathode electrode 14 and an edge of the corresponding gate electrode 18. In the present exemplary embodiment, the acute angles $\alpha$ and $\beta$ are about 45°.

This disposition of the spacer 28 can minimize a bad effect that affects the electron emission regions 20 in the pixel areas DA by the imaginary spacer regions 40 formed on the electron emission unit 100. This can be estimated by a degree to which the electron emission regions 20 in the pixel areas DA are screened by the imaginary spacer regions 40.

FIG. 4 is a comparative example that is identical to the above exemplary embodiment except for the disposition of the spacers. In the comparative example, each side of the spacer 28' is perpendicular to an edge of the corresponding cathode electrode 14' or an edge of the corresponding gate electrodes 18'. That is, angles $\alpha$ and $\beta'$ between each side of the spacer 28' and the edge of the corresponding gate electrode 18' and between each side of the spacer 28' and the edge of the corresponding cathode electrode 14' are about 90°.

Referring to FIGS. 3 and 4, it can be noted that the disposition of the spacers 28 according to the exemplary embodiment can significantly reduce the number of the electron emission regions included in the imaginary spacer regions 40 as compared with the disposition of the spacers according to the comparative example. For example, in the exemplary embodiment, four electron emission regions 20 are included in each imaginary spacer region 40. On the other hand, in the comparative example, sixteen electron emission regions 20' are included in each imaginary spacer region 40'.

The following will describe the exemplary embodiment and the comparative example in more detail.

When a portion where the imaginary spacer region overlaps the pixel areas is referred to as a "non-emission region," the non-emission region of the exemplary embodiment will be referred to as a "first non-emission region S1", and the non-emission region of the comparative example will be referred to as a "second non-emission region S2".

Further, in the exemplary embodiment and the comparative example, a gap between the adjacent pixel areas DA will be referred to as "G", and a length of each side of the imaginary spacer region 40 and 40' will be referred to as "A". The gap G may be defined in the x-axis direction or the y-axis direction.

For convenience, it is assumed that the gap G in the x-axis direction is identical to the gap G in the y-axis direction.

In this case, the first non-emission region S1 and the second non-emission region S2 can be expressed as the following Equations 1 and 2.

$$S1 = 4X\left\{\frac{1}{2}(A-G)X\frac{1}{2}(A-G)\right\} = (A-G)^2 \quad \text{[Equation 1]}$$

$$S2 = 4X\left\{\frac{1}{2}\left(\frac{A}{\sqrt{2}}-G\right)X\left(\frac{A}{\sqrt{2}}-G\right)\right\} = \frac{1}{2}(\sqrt{2}A-2G)^2 \quad \text{[Equation 2]}$$

Further, a difference (S1-S2) between the first non-emission region S1 and the second non-emission region S2 can be expressed as the following Equation 3.

$$S1 - S2 = (A-G)^2 - \frac{1}{2}(\sqrt{2}A-2G)^2 = G^2\left\{2(\sqrt{2}-1)\frac{A}{G}-1\right\} \quad \text{[Equation 3]}$$

Here, the difference (S1-S2) depends on the side length A and the gap G. Therefore, the first non-emission region S1 and the second non-emission region S2 maintain the following conditions 4), 5), and 6) in accordance with the following Equations 1), 2), and 3).

$$1)\ A > \frac{\sqrt{2}+1}{2}G = 1.207G$$

$$2)\ A = \frac{\sqrt{2}+1}{2}G$$

$$3)\ A < \frac{\sqrt{2}+1}{2}G$$

$$4)\ S1 > S2$$

$$5)\ S1 = S2$$

$$6)\ S1 < S2$$

Substantially, in the light emission device 100 of the exemplary embodiment, the gap G is maintained to be hundreds of μm and the side length A is maintained to be several mm while the gap between the first and second substrates 10 and 12 is maintained to be about 10 mm.

Figure 5:
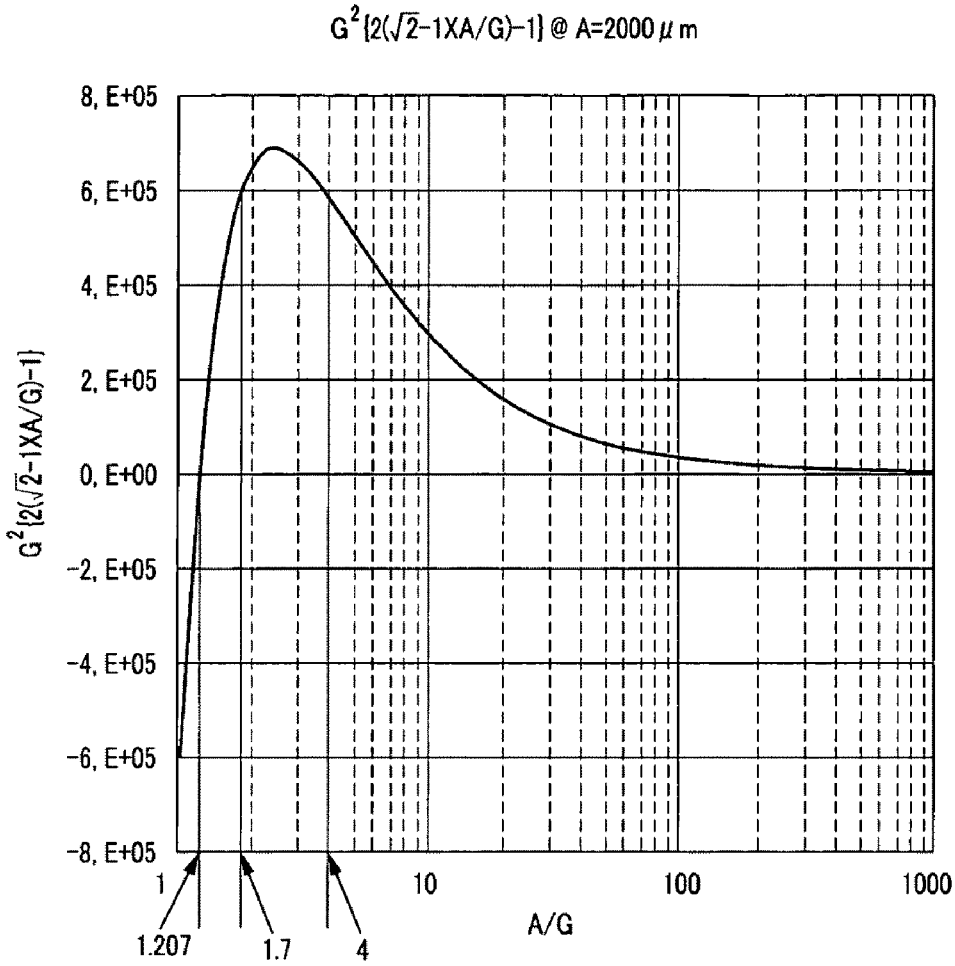
FIG. 5 is a graph illustrating non-emission regions formed by spacers of FIGS. 3 and 4.

FIG. 5 is a graph illustrating Equation 3. In this embodiment, the side length A is about 2 mm.

As described above, in the present exemplary embodiment, the spacer 28 is disposed such that each side thereof is at an acute angle with respect to the edges of the corresponding driving electrodes to thereby minimize the non-emission area in the pixel areas DA.

Figure 6:
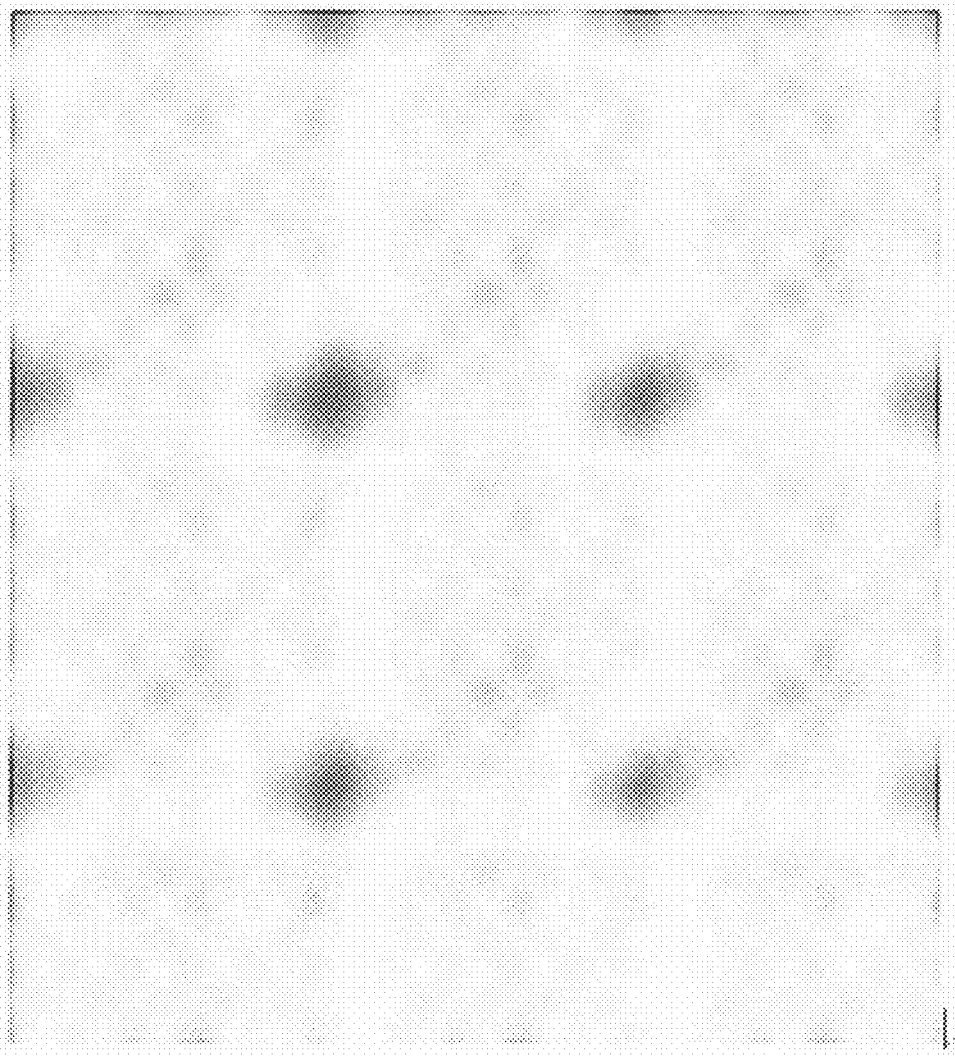
FIG. 6 is a simulated photograph illustrating a light emission state of the light emission device of FIG. 1.
Figure 7:
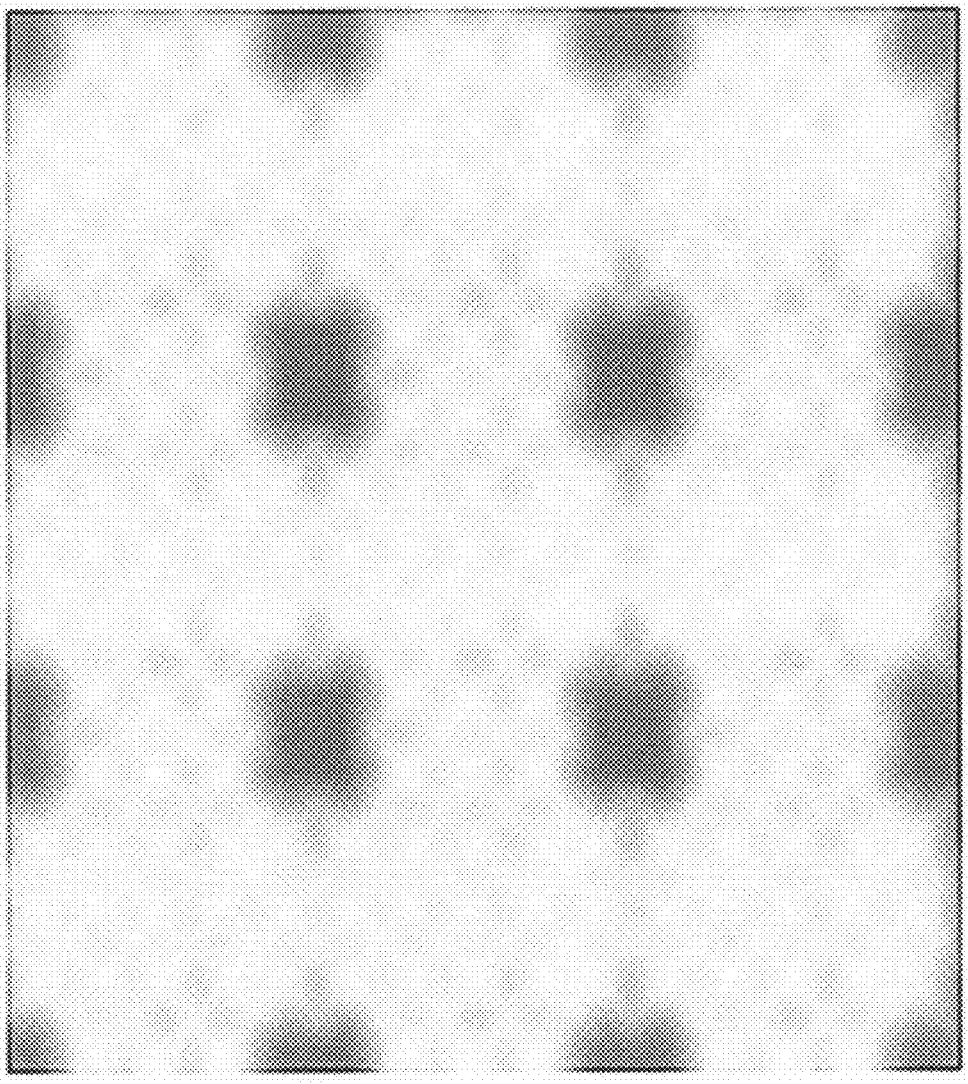
FIG. 7 is a simulated photograph illustrating a light emission state of the light emission device of FIG. 4.

FIG. 6 is a simulation photograph illustrating a light emission state of the light emission device of the exemplary embodiment, and FIG. 7 is a simulation photograph illustrating a light emission state of the light emission device of the comparative example.

As shown in FIGS. 6 and 7, it can be noted that the non-emission area in the pixel areas DA of the light emission device of the exemplary embodiment is significantly less than the non-emission area in the pixel areas DA of the light emission device of the comparative example.

Therefore, most of the electron emission regions 20 in the pixel areas DA of the light emission device of the exemplary embodiment contribute to the visible light emission, thereby improving the luminance of the light emission surface. Further, when an identical voltage is applied to all of the pixel areas DA, electron emission amounts of the pixel areas are identical to each other.

Figure 8:
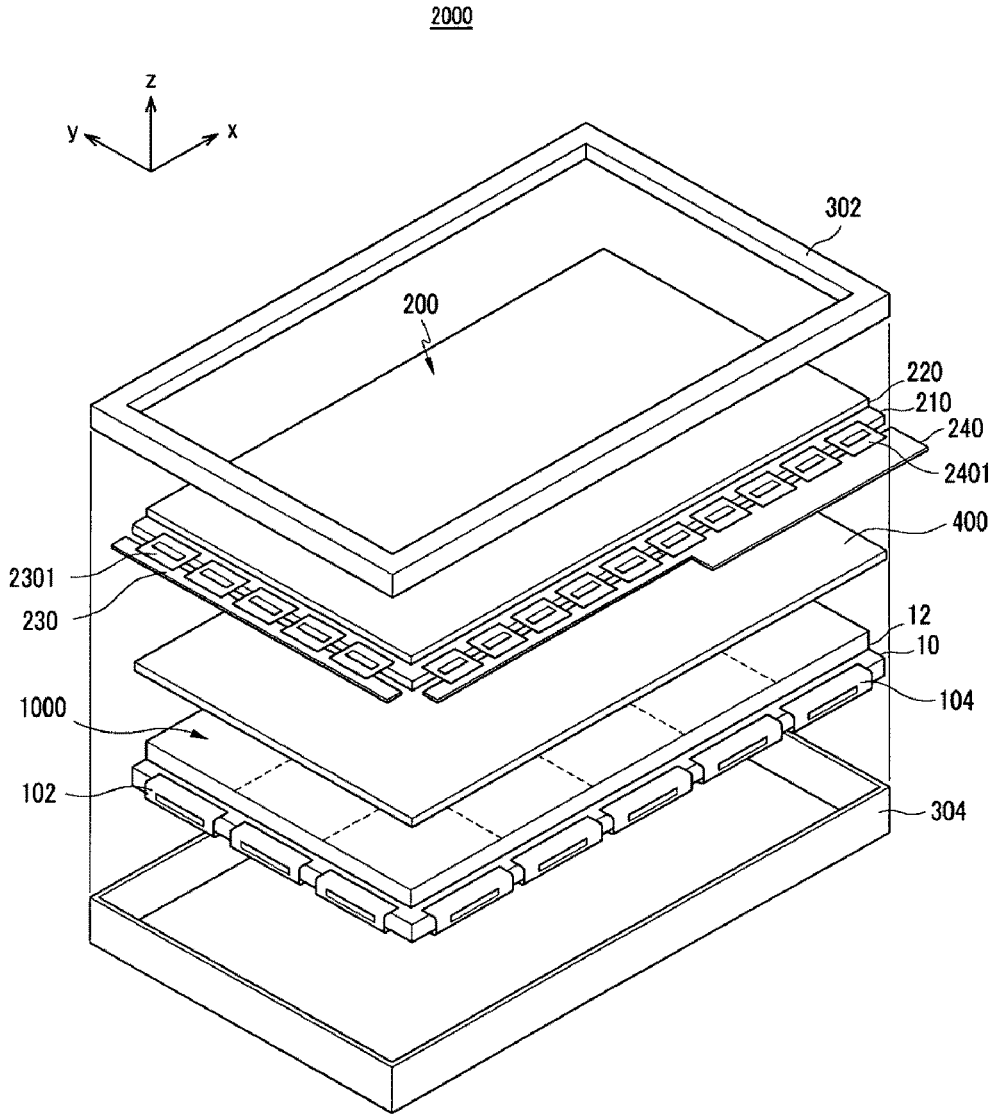
FIG. 8 is an exploded perspective view of a display according to an exemplary embodiment.

FIG. 8 shows a display 2000 having the light emission device 1000 according to an exemplary embodiment.

Referring to FIG. 8, the display 2000 of this exemplary embodiment includes the light emission device 1000 and a display panel 200 disposed on the light emission device 1000. Further, the display 2000 further includes first and second fixing members 302 and 304 for fixedly supporting the display panel 200 and the light emission device 1000. A diffusion plate 400 is installed between the display panel 200 and the light emission device 1000 to diffuse light emitted from the light emission device 1000. The diffusion plate 400 is spaced apart from the light emission device 1000 by a predetermined distance.

The display panel 200 may be a liquid crystal display panel or another passive type (non-emissive type) display panel. In the following description, the display panel 200 will be described as a liquid crystal display panel by way of example.

The display panel 200 includes a thin film transistor (TFT) substrate 210 on which a plurality of TFTs are formed, a color filter substrate disposed above the TFT substrate 210, and a liquid crystal layer (not shown) formed between the TFT substrate 210 and the color filter substrate 220. Polarizing plates (not shown) are attached on a top surface of the color filter substrate 220 and a bottom surface of the TFT substrate 210 to polarize the light passing through the display panel 200.

The TFT substrate 210 is a transparent glass substrate on which the TFTs are formed in a matrix pattern. The TFT substrate 210 includes a source terminal (not shown) connected to a data line (not shown) and a gate terminal (not shown) connected to a gate line (not shown). The TFT substrate 210 further includes a drain terminal (not shown) on which a pixel electrode formed of a transparent conductive layer is formed.

When electric signals are input from gate and data flexible printed circuit boards 230 and 240 to the gate and data lines, respectively, electric signals are input to the gate and source terminals of the TFTs. The TFTs are turned on or off in accordance with the input of the electric signals.

The color filter substrate 220 is a panel in which RGB pixels are formed through a thin film process to thereby realize predetermined colors as the light passes therethrough. A common electrode formed of a transparent conductive film is deposited on an entire surface of the color filter substrate 220.

When electric power is applied to the gate and source terminals of the TFTs to turn on the TFTs, electric fields are formed between the pixel electrode and the common electrode of the color filter substrate 220. Liquid crystal molecules of the liquid crystal layer formed between the TFT substrate 210 and the color filter substrate 220 are oriented at predetermined twisting angles in accordance with the electric fields and the light transmittances of the pixels are individually varied in accordance with the twist angles of the liquid crystal molecules.

The gate and data flexible printed circuit boards 230 and 240 of the display panel 200 are respectively connected to the gate and data lines through driving IC packages 2301 and 2401. In order to drive the display panel 200, the gate flexible printed circuit board 230 transmits a gate driving signal and the data flexible printed circuit board 240 transmits a data driving signal.

The light emission device is a light source supplying light to the display panel 200. The light emission pixels can be independently driven as represented by dotted lines. A plurality of gate lines (not shown) and a plurality of data lines (not shown) are formed in the light emission device 100 and connected to a printed flexible circuit through driving integrated circuit packages 102 and 104, respectively. The flexible printed circuit boards are located on a rear surface of the light emission device 1000. The flexible printed circuit board applies driving signals to the gate and data lines to drive the light emission device 1000.

The light emission device 1000 forms a smaller number of pixels than the display panel 200 such that one of the pixels of the light emission device 1000 corresponds to two or more of the pixels of the display panel 200. Each of the pixels of the light emission device 1000 can emit light in response to the highest gray scale of the corresponding pixels of the display panel 200. The light emission device 1000 is able to display a gray scale of 2 to 8 bits for each of the pixels thereof.

For convenience, the pixels of the display panel 200 are referred to as first pixels, the pixels of the light emission device 1000 are referred to as second pixels, and the first pixels corresponding to one of the second pixels are referred to as a first pixel group.

The following will describe a driving process of the light emission device 1000. A signal controller (not shown) for controlling the display panel 200 detects the highest gray scale of the first pixels of the first pixel group. The signal controller calculates a gray scale required for light illumination of the second pixel according to the detected gray scale and coverts this gray scale into digital data. The signal controller generates drive signals for the light emission panel using the digital data.

The drive signals of the light emission device 1000 include scan and data drive signals. When the first pixel group displays an image, the corresponding second pixel of the light emission device 100 is synchronized with the first group to thereby emit light at a predetermined gray scale. In the light emission device 1000 according to the exemplary embodiment, the light emission intensities of the pixels are independently controlled such that a suitable intensity of light can be supplied to each of the pixels of the display panel 200.

The above-described light emission device 1000 can be driven using less power than an LED device or CCFL device, and can independently control the light emission intensities of the pixels. Therefore, the light emission device can contribute to enhancing a dynamic contrast of images realized by the display panel, thereby improving the image quality.

According to the light emission device of the exemplary embodiment, the disposition of the spacers is improved to minimize the non-emission area caused by the spacers. Therefore, most of the electron emission regions in the pixel areas can contribute to the visible light emission and thus the luminance of the image can be enhanced.

Further, when the display uses the light emission device, the contrast of the image is enhanced and thus the display quality is improved.

While the present embodiments have been described in connection with what is presently considered to be practical exemplary embodiments, it is to be understood that the present embodiments are not limited to the disclosed embodiments, but, on the contrary, is intended to cover various modifications and equivalent arrangements included within the spirit and scope of the appended claims.

What is claimed is:

1. A light emission device, comprising:

first and second substrates arranged opposite to each other;

an electron emission unit comprising driving electrodes provided on the first substrate;

a light emission unit provided on the second substrate; and spacers that are supportably disposed between the first and second substrates, wherein the spacers are formed in a pillar configuration and wherein each side of the spacers is arranged at an acute angle with respect to an edge of the driving electrodes of the electron emission unit, wherein the driving electrodes include cathode electrodes and gate electrodes insulated from the cathode electrodes, and wherein the center of the spacers is located at a region which does not contact the gate electrodes and the cathode electrodes.

2. The light emission device of claim 1, wherein:

the spacers are formed in a square pillar configuration.

3. The light emission device of claim 1, wherein the gate electrodes are disposed perpendicular to the cathode electrodes.

4. The light emission device of claim 3, wherein the spacers are located at regions where the cathode electrodes do not intersect the gate electrodes.

5. The light emission device of claim 1, further comprising a plurality of pixel areas spaced apart from each other by a predetermined gap, wherein the spacers are disposed in the gap.

6. The light emission device of claim 1, wherein the spacers are formed in an exact square pillar configuration.

7. A display comprising:

a display panel configured to display an image; and a light emission device supplying light to the display panel, wherein the light emission device comprises first and second substrates arranged opposite to each other, an electron emission unit comprising driving electrodes provided on the first substrate, a light emission unit provided on the second substrate, and spacers that are supportably disposed between the first and second substrates, wherein the spacers are formed in a pillar configuration and each side of the spacers is arranged at an acute angle with respect to an edge of driving electrodes of the electron emission unit, wherein the driving electrodes include cathode electrodes and gate electrodes insulated from the cathode electrodes, and wherein the center of the spacers is located at a region which does not contact the gate electrodes and the cathode electrodes.

8. The display of claim 7, wherein the spacers are formed in a square pillar configuration.

9. The display of claim 7, wherein the gate electrodes are disposed perpendicular to the cathode electrodes.

10. The display of claim 9, wherein the spacers are located at a region where the cathode electrodes do not intersect the gate electrodes.

11. The display of claim 7, further comprising a plurality of pixel areas spaced apart from each other by a predetermined gap, wherein the spacers are disposed in the gap.

12. The display of claim 7, wherein the spacers are formed in an exact square pillar configuration.

* * * * *